US005277009A

United States Patent [19]

Yamaguchi et al.

[11] Patent Number: 5,277,009

[45] Date of Patent: Jan. 11, 1994

[54] EXTERIOR WALL UNITS COMPRISING SIDING MEMBERS AND TILES

[75] Inventors: Kenji Yamaguchi; Shun-ichi Kobayashi; Fumitoshi Okazaki, all of Tokyo, Japan

[73] Assignee: Sanwa Shutter Corporation, Tokyo, Japan

[21] Appl. No.: 809,480

[22] PCT Filed: May 22, 1990

[86] PCT No.: PCT/JP90/00647

§ 371 Date: Jan. 8, 1992

§ 102(e) Date: Jan. 8, 1992

[87] PCT Pub. No.: WO91/18159

PCT Pub. Date: Nov. 28, 1991

[51] Int. Cl.[5] ..... E04F 13/08

[52] U.S. Cl. ..... 52/387; 52/482; 52/551

[58] Field of Search ..... 52/551, 36.1, 387, 482, 52/508, 510, 550

[56] References Cited

U.S. PATENT DOCUMENTS

| | | | |
|---|---|---|---|
| 392,902 | 11/1888 | Blakeney | 52/387 |
| 4,803,821 | 2/1989 | Funaki | 52/551 X |
| 4,987,712 | 1/1991 | Mancuso | 52/387 |
| 5,029,425 | 7/1991 | Bogataj | 52/551 X |

FOREIGN PATENT DOCUMENTS 2155970 12/1984 United Kingdom .

*Primary Examiner*—Carl D. Friedman
*Assistant Examiner*—Beth A. Aubrey
*Attorney, Agent, or Firm*—Ladas & Parry

[57] ABSTRACT

According to the invention, there is provided an exterior wall unit for an exterior wall of a building structure, which comprises a siding member (10) made of a metal and one or more porcelain tiles (20) corresponding in size to and fitted to the outside surface of the siding member (10), the siding member (10) having the outside surface formed with engaging means (16) extending in the horizontal direction for engagement with the tile or tiles (20), each tile (20) being formed with engaging means (23) for engagement with the engaging means (16) of the siding member (10), each tile (20) being coupled to the outside surface of the siding member (10) to be integral therewith with the engagement of both the engaging means (16, 23). In a basic mode of invention, the engaging means (16) of the siding member (10) is constituted by a downwardly directed and an upwardly directed L-shaped portion formed along the upper and lower edges, respectively, and the engaging means (23) of each tile (20) is constituted by upper and lower edge portions capable of being fitted in the spaces defined by the L-shaped portions, each tile being fitted in the siding member (10) with sidewise sliding therealong, the engaging means of the siding member (10) forming a tile cross joint (19) when vertically adjacent siding members (10) are coupled together.

8 Claims, 13 Drawing Sheets

EXTERIOR WALL UNITS COMPRISING SIDING MEMBERS AND TILES

CROSS REFERENCE TO RELATED APPLICATION

The first named inventor of the present invention, Kenji Yamaguchi, filed a prior design application with the United States Patent and Trademark Office on May 18, 1990 entitled "Tiles", bearing Ser. No. 07/535,959. USSN 07/535,959 is based on Japanese Utility Model Appln. No. 63-151968, filed Nov. 22, 1988 mentioned in the Declaration/Power filed concurrently herewith.

FIELD OF THE INVENTION

This invention relates to exterior wall unit structures using tiles applied to outside surface of buildings and, more particularly, to exterior wall units having dry construction formed by using siding members and tiles.

PRIOR ART STATEMENT

In the prior art, there are well-known siding members, which are in the form of boards comprising metal base members and fillers filling the base members for ensuring insulation against heat and sound, the fillers being synthetic resin foams such as polyurethane foam, glass wool, rock wool and asbestos. They are used as exterior materials or finishing materials for building construction. However, any base member is formed as a finishing material by coating a steel sheet and fitted as exposed exterior materials. Therfore, its processing is limited, and it lacks imposing characters and high class senses.

On the other hand, tile finishing is adopted for regular buildings such as reinforced concrete buildings. It is superior in imposing characters, and it is practiced in various processes by setting tile units. However, joint structures between adjacent tile units require site works by experts skilled in the tile finishing and such works are inefficient. Further, there is a social problem that the number of the experts is decreasing. Further, the solidification of mortar by drying imposes limitations on the construction period.

There is a technique for simplifying the tile setting, as disclosed in Japanese Utility Model Disclosure No. 147,832/1984 In this technique, supports are secured to plate members of a building body, and tiles are assembled by sliding engagemant with the supports. In this case, however, such site assembly works as the securing of the supports and fitting of the tiles by sliding engagement are necessary after securing the plate members on the building body side. The process thus requires a large number of steps and fails to greatly contribute to the reduction of construction period. Besides, if an error is produced in the assembling of the supports, it disables subsequent regular tile assembling and causes finish irregularities. At any rate, therefore, works by experts are necessary.

SUMMARY OF THE INVENTION

The present invention has been intended in the light of the above situation, and it has an object of providing an exterior wall unit structure comprising one or more siding members and one or more tile units, which can preclude the drawbacks inherent in the prior art.

Another object of the invention is to provide an exterior wall unit, which both the siding members and tile units are provided with engaging means for mutual engagement. Thus it enables to set tiles simutaneously with the assembling of siding members to a building body side.

To attain the above objects of the invention, there is basically provided an exterior wall unit structure for constituting the exterior wall of a building structure, which comprises a siding member made of metal and one or more procelain tiles corresponding in size to and fitted to the outside surface of the siding member, the siding member having the outside surface formed with engaging means extending in the horizontal direction for engagement with the tile or tiles, each tile being formed with engaging means for engagement with the engaging means of the siding member, each tile being coupled to the outside surface of the siding member to be integral therewith the engagement of both the engaging means. The siding member may be formed by metal sheet such that opposed paired sides thereof are formed with connecting means enabling fitting connection between adjacent siding members.

According to the invention, the engaging means may be in various forms. In a basic mode of the invention, the engaging means of the siding member is constituted by a downwardly directed and an upwardly directed L-shaped portion formed along the upper and lower edges, respectively, and the engaging means of each tile is constituted by upper and lower edge portions capable of being fitted in the space defined by the L-shaped portins, each tile being fitted in the siding member with sidewise sliding therealong, the engaging means of the siding members forming a tile cross joint when vertically adjacent siding members are coupled together. Such siding members and tiles are combined along with joint members fitted in tile build joints.

In a second mode of the invention, the engaging means of the siding member is constituted by two upwardly bent portions one formed along the upper edge and the other formed beneath and parallel thereto, and the engaging means of each tile is constituted by two downwardly bent portions formed at the time of molding on the back one along the upper edge and the other beneath and parallel thereto, these downwardly bent portions being supported by the upwardly bent portions, each tile being temporarily fitted to the siding member when it is hooked thereon from above, a tile cross joint member being fitted in a tile cross joint formed between vertically adjacent siding members coupled together to secure the tiles having been temporarily fitted on the upwardly bent portions.

In a third mode of the invention, the engaging means of the siding member is constituted by an outside recessed portion having a sectional profile like a dovetail, and the engaging means of each tile is constituted by a metal member fitted in a back side recessed portion between the upper and lower edges of the tile and corresponding in the width to the outside recessed portion, each tile being elastically fitted in and held by siding member by forcibly fitting the metal member in the outside recessed portion of the siding member, a tile cross joint member being fitted in a tile cross joint formed between vertically adjacent siding members coupled together.

In the above various modes, the siding member and tiles are assembled together with their engaging means to be provided as exterior wall units having a size determined by the size of the siding member. Thus, not only the drawbacks noted above inherent in the prior art can be precluded, but also any expert skill is no longer needed, and contribution to the reduction of the construction period can be obtained.

The above and other objects, features and advantages of the invention will become more apparent from the detailed description of the preferred embodiment when the same is read with reference to the accompanying drawings.

BRIEF DESCRIPTION OF THE DRAWINGS

FIGS. 1 to 7 illustrate a basic structure of the exterior wall unit according to the invention, in which:

FIG. 1 is a perspective view, partly in section, showing the outside surface of an exterior wall;

FIG. 2 is a standard verical sectional view taken along line A—A in FIG. 1 showing the exterior wall;

FIG. 3 is a vertical sectional view taken along line B—B in FIG. 1 showing a tile build joint;

FIGS. 4 and 5 are a front and a back vertical view, respectively, showing features of a tile;

FIG. 6 is a perspective view showing a tile build joint member; and

FIG. 7 is a horizontal sectional view showing a tile build joint member;

FIGS. 11 to 18 illustrate a second mode of the invention, in which:

FIG. 11 is a standard vertical sectional view showing an exterior wall;

FIG. 12 is a vertical sectional view showing a tile build joint;

FIG. 13 is a vertical sectional view showing a siding member;

FIGS. 14 and 15 are a back vertical view and a vertical sectional view, respectively, showing a tile;

FIG. 16 is a perspective view showing a tile build joint member;

FIG. 17 is a sectional view showing a tile cross joint member; and

FIGS. 18 and 19 are horizontal sectional views showing joints of siding members at an inside and an outside corner of wall;

FIGS. 20 to 24 illustrate a third mode of the invention, in which:

FIG. 20 is a perspective view, partly in section, showing an exterior wall unit;

FIG. 21 is a standard vertical sectional view showing the pertinent exterior wall;

FIG. 22 is a back side perspective view showing a tile;

FIG. 23 is a back side perspective view showing a trim tile;

FIG. 24 is a perspective view showing a tile build joint member;

DETAILED DESCRIPTION OF THE PREFERRED EMBODIMENTS

Figure 1:
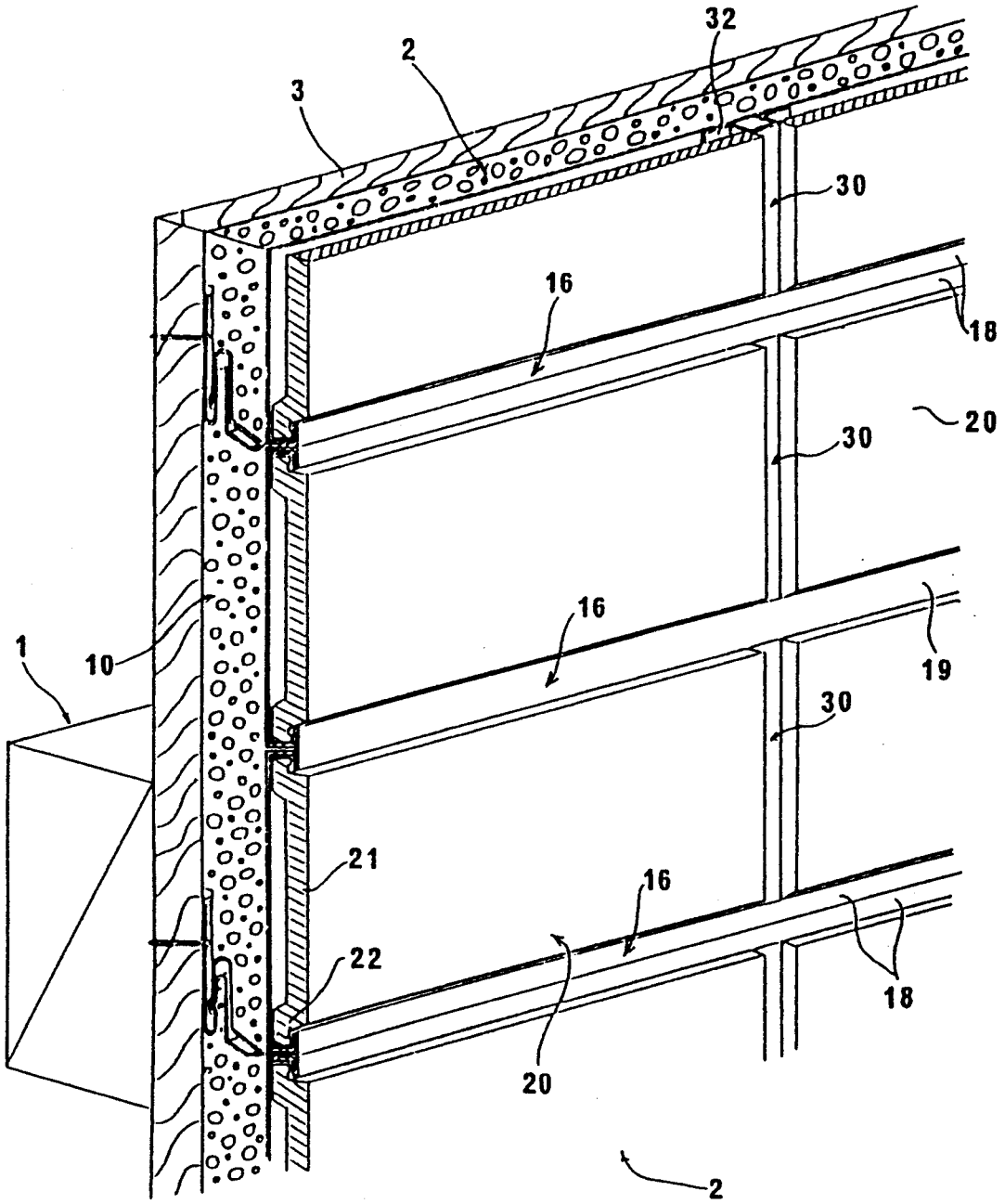
Figure 2:
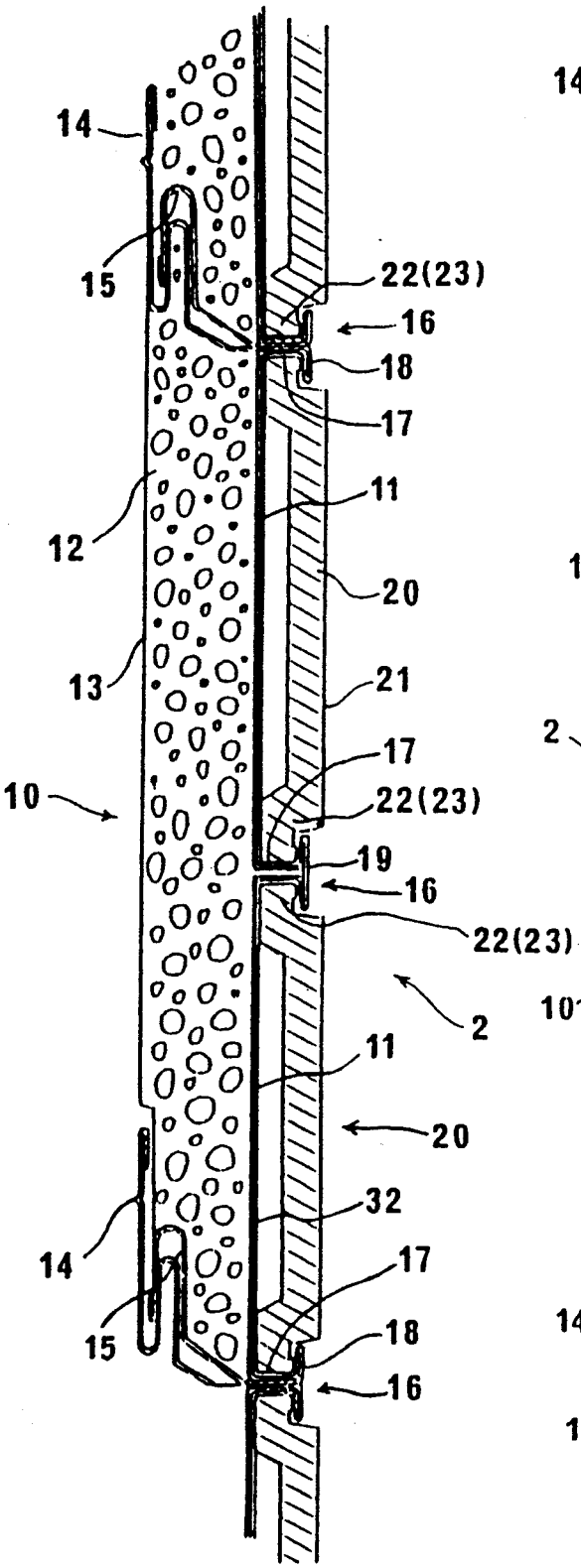

The exterior wall unit structure according to the invention will now be described in conjunction with preferred embodiments of the invention applied to wooden buildings.

FIGS. 1 to 7 show an embodiment of the invention. Referring to the Figures, designated at 1 is a building frame part, e.g., a pillar, a beam, a furring strip, etc., at 2 is an exterior wall rough back. According to the invention, the exterior wall 2 comprises siding members 10 and tiles 20 secured to one another.

Each siding member is a board including a base member 11, which is formed by bending a metal sheet and has regular dimensions corresponding to a predetermined number of unit tiles 20, a heat/sound insulating material 12 filling a back side space defined by the base member 11, and a back finish member 13. The heat/-sound insulating material 12 may be selected from well-known materials.

The base member 11 has edge overlap portions 14 and 15 formed along its upper and lower edges. Vertically adjacent two base members 11 are connected together with the overlap of their corresponding edge overlap portions 14 and 15. On its exterior side, the base member 11 is provided with engaging means 16. In this embodiment, the engaging means 16 is adapted to retain two, i.e., an upper and lower, rows of tiles 20. More specifically, it is constituted by an upper and a lower L-shaped flange 17 and an intermediate T-shaped flange 18 located at the position of a tile bed joint. The upper and lower L-shaped flanges 17 define respective grooves open at the bottom and at the top, while the intermediate T-shaped flange 18 defines an upper and a lower groove 17 respectively facing the grooves of the upper and lower L-shaped flanges 17. A tile bed joint member 19 constitutes part of the engaging means 16. The member 19 has double the vertical dimension of the L-shaped flanges 18.

Figure 4:
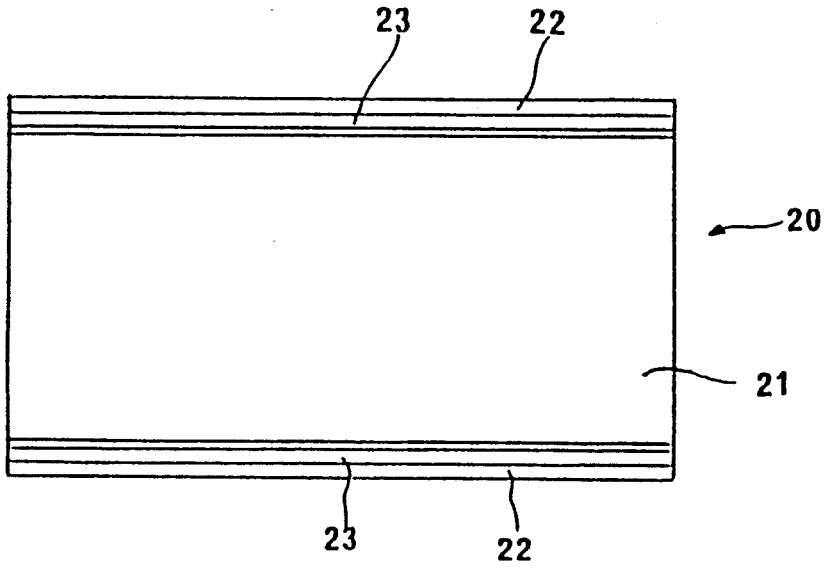
Figure 5:
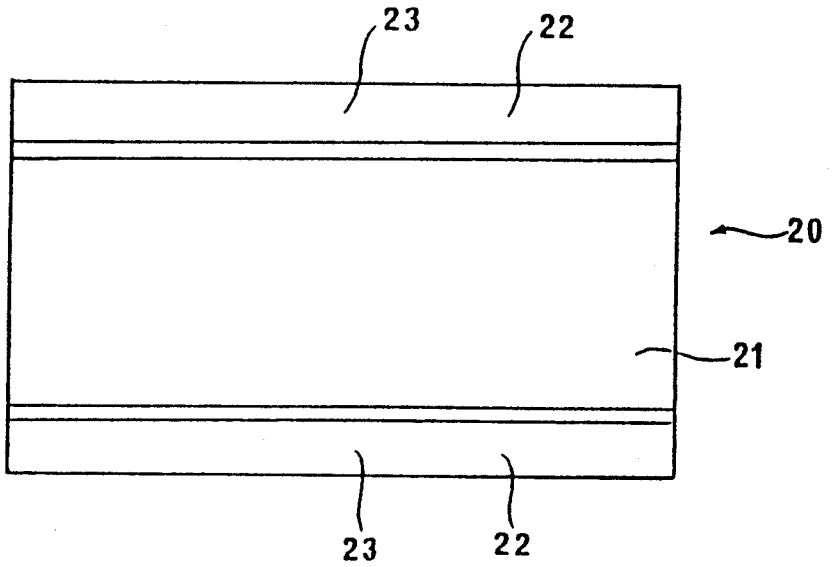

Each tile 20 is a porcelain tile. As shown in FIGS. 4 and 5, it has a main portion 21 and an upper and a lower edge portion 22. The edge portions 21 and 22 have a thickness t slightly smaller than the width b of the grooves 17. These portions constitute engaging means 23 to let the tile be retained by the siding member 10. The main portion 21 is stepped with respect to the edge portions 22 has a sectional profile projecting from the exterior surface of the upper and lower L-shaped flanges 18 and intermediate bed joint member 19.

Figure 3:
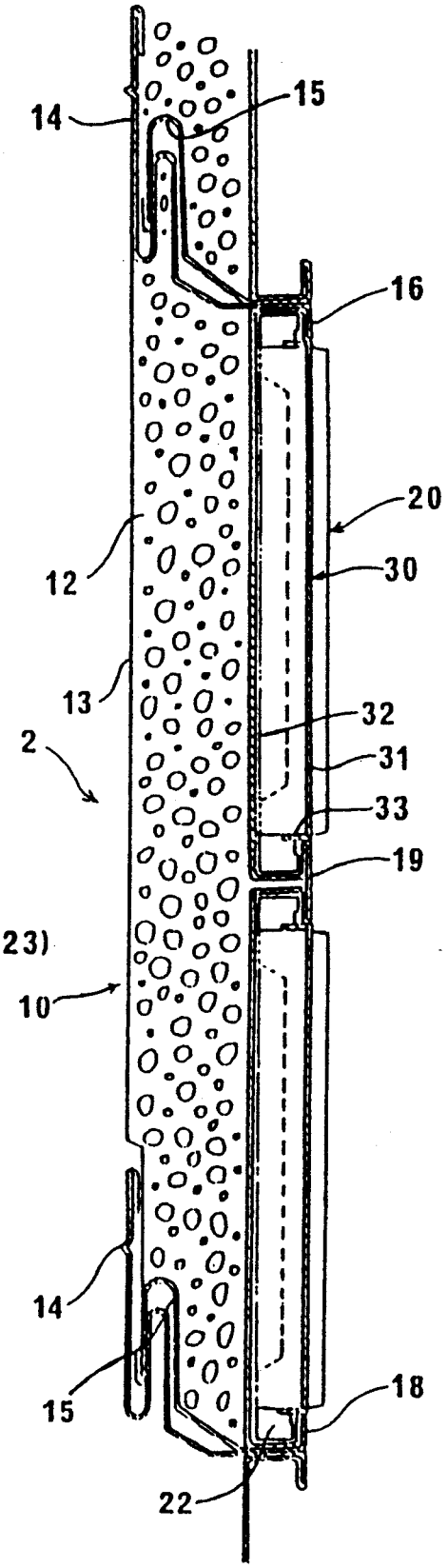
Figure 6:
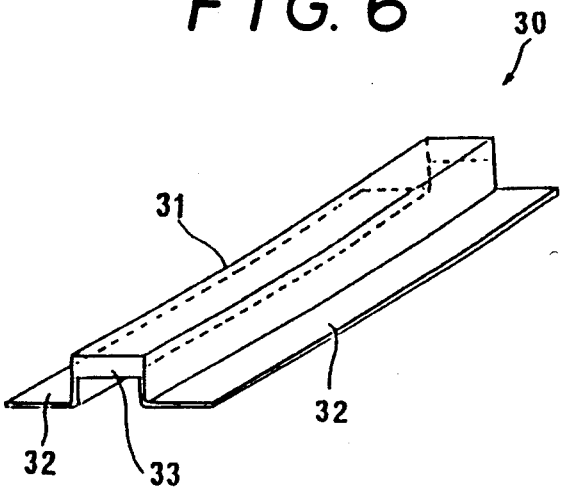
Figure 7:
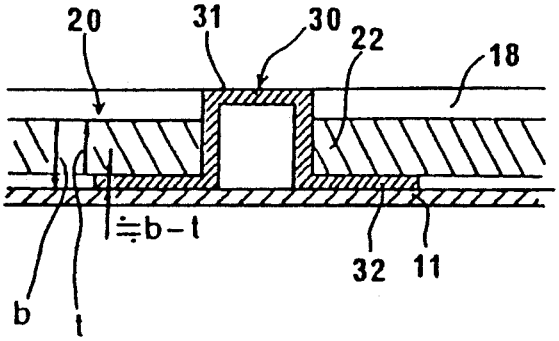

As shown in FIG. 3, a tile build joint member 30 is provided between adjacent members 20. As shown in FIGS. 6 and 7, the tile build joint members 30 has a sectional profile like that of a hat, and it has a vertical dimension such that it touches L-shaped flange at one end and touches tile bed joint member 19 at the other end. It has a main portion 31 and opposite side flange portions 32. Each end of the main portion 31 has a bent end closure portion 33. Each flange portion 32 has a thickness substantially equal to the difference between the width b of the grooves 17 and the thickness t of the edge portions 22 of the tiles 20.

The siding members 10, tiles 20 and tile build joint members 30 may be prepared as units for forming the exterior wall 2, each unit being assembled with each siding member 10 as a base. Each flange 20, which has the sectional profile as noted above and engaging means 20, it is fitted by sliding it while being guided by an L-shaped flange 18 and a corresponding side of tile bed joint member 19. Tile build joint members 30 are inserted alternately with tiles 20 and fitted such that their flange portions 32 are laid on the back side of the edge portions of the tiles 20. The engaging means 16 of the siding members 10 are exposed as horizontal tile build joints, but the engaging means 23 of the tiles 20 are not exposed as any exterior member.

Figure 8:
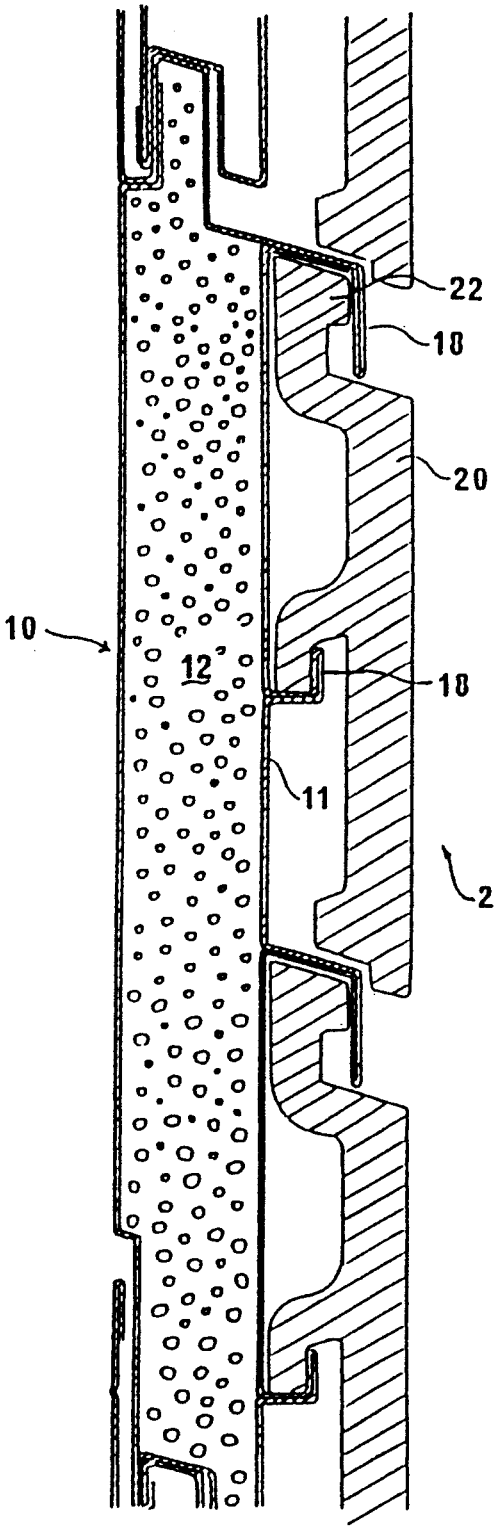
FIGS. 8 to 10 are vertical sectional views showing a second to a fourth embodiment.
Figure 9:
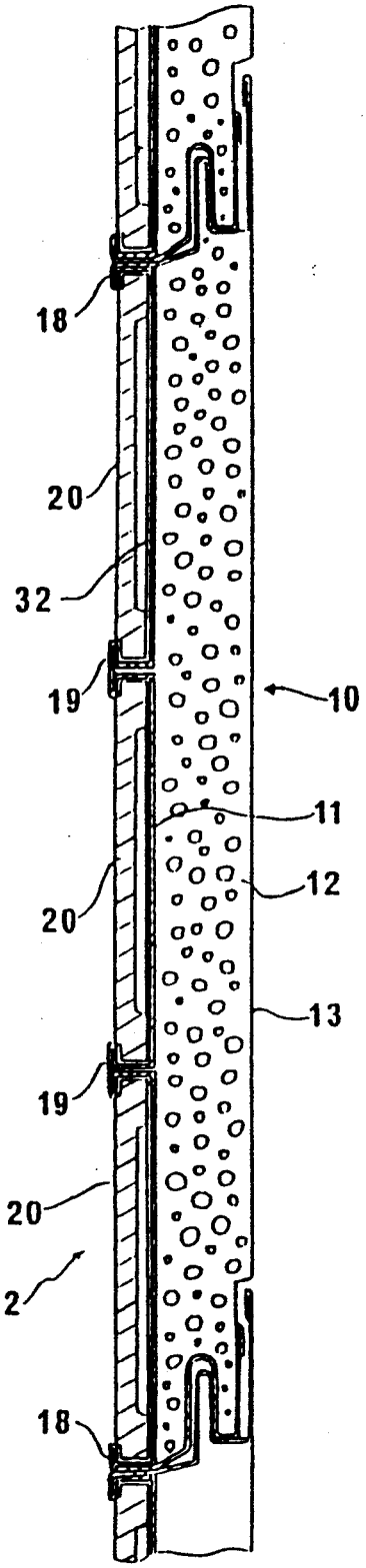
Figure 10:
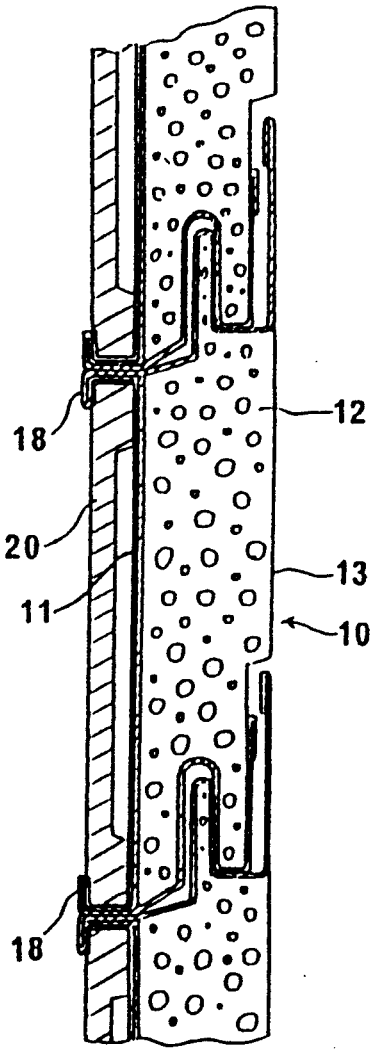
Figure 11:
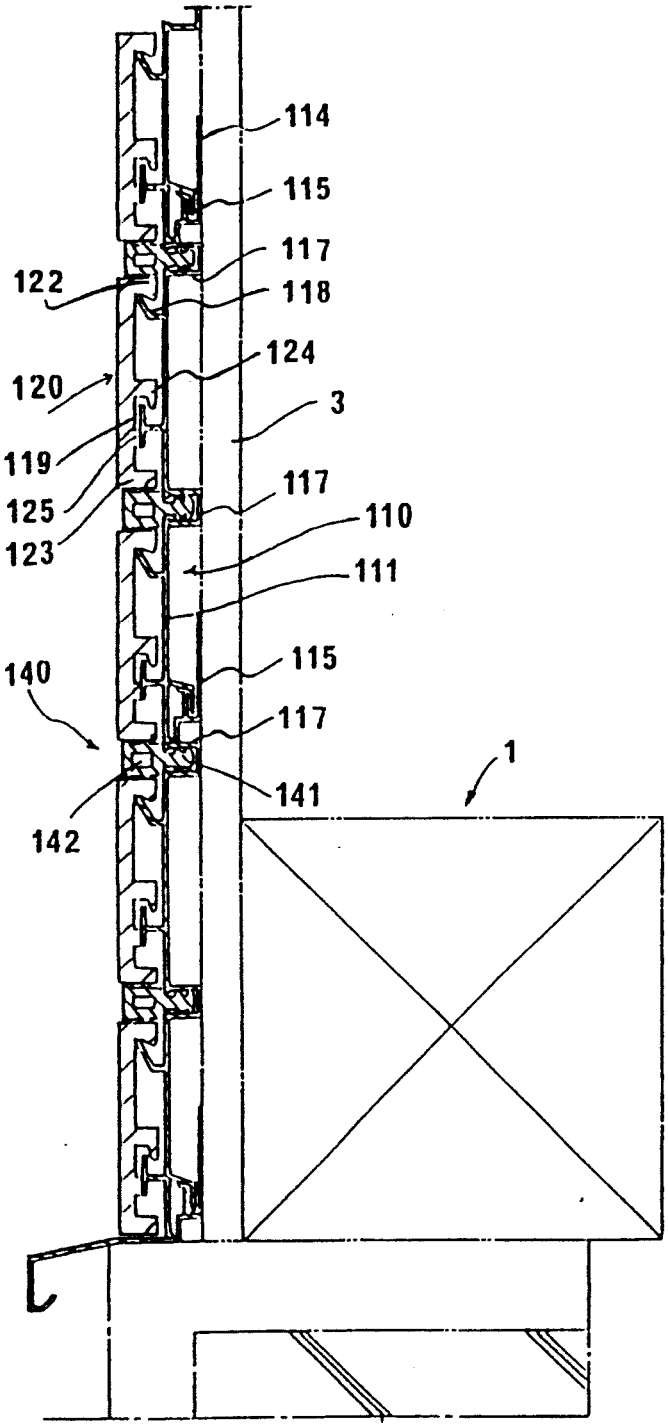
Figure 12:
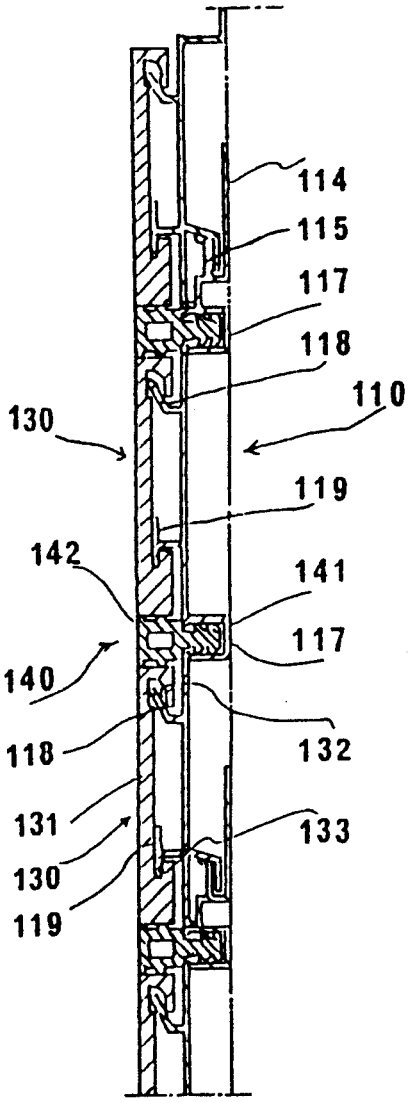

According to the invention, the shapes and numbers of the siding members 10 and tiles 20 of the exterior wall formation unit may be suitably selected in ranges which do not depart from the basic structure. FIGS. 8 to 10 are sectional views showing modifications of the above exterior wall formation unit. In the structure of FIG. 8, each siding member 10 and each tile 20 have upper edge engaging means 16 and intermediate engaging means 23. Their lower edges are not provided with any engaging means but are adapted for sliding engagement. In the structure of FIGS. 9 and 10, each siding member 10 has a size corresponding to three rows and a single row, respectively, of tiles 20.

FIGS. 11 to 17 show an exterior wall 2 according to a second mode of the invention. In these Figures, each siding member is designated at 110 instead of 10. For other parts, only those like those in FIG. 1 are designated by like reference numerals. In this exterior wall, the siding member 110 is a board member constituted solely by a base member 111. However, it is possible to incorporate the insulating material 12 and back finish member 13 having the structures described above. The exterior engaging means of the base member 111 for engagement with tiles 20 is designated at 116 instead of 16, and also the horizontal tile cross joint has a different structure. The tiles, therefore, are designated at 120 instead of 20.

Figure 13:
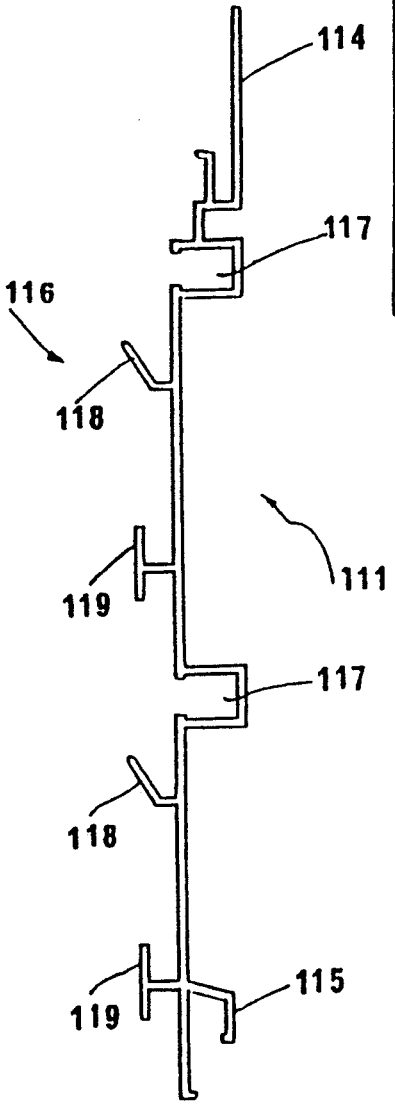

FIG. 13 shows the base member 111. As is shown, it is an extrusion molded sheet-like member, and has an upper and a lower lap portion 114 and 115. Between the upper lap portion 114 and an intermediate cross joint position is formed a groove 117, in which a tile cross joint member 140 is fitted. The exterior engaging means 116 for engagement with tiles 120 consists of upwardly bent engaging portions 118 each formed beneath each groove 117 and a T-shaped engaging portion 119 formed between the groove 117 noted above and a lower groove 117. That is, the engaging means two vertical steps, which recur one after another.

Figure 14:
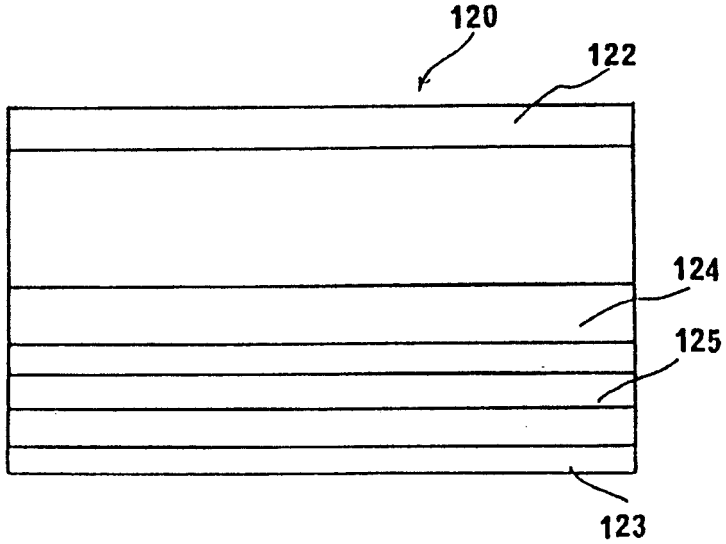
Figure 15:
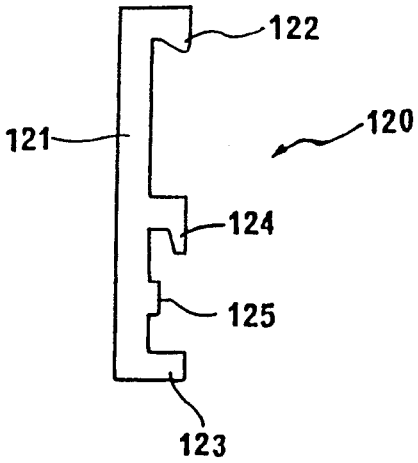

FIGS. 14 and 15 show the tile 120. As is shown, the tile has a main portion 121, an upper and a lower engaging portion 122 and 123 projecting from the back side of the upper and lower edges of the main portion 121, an intermediate engaging portion 124 projecting from the back side of the main portion 121 and having a substantially L-shaped sectional profile and a further engaging portion 125 provided beneath the intermediate engaging portion 124. The upper and intermediate engaging portions 122 and 124 have respective downwardly inclined surfaces for engagement with the respective engaging portions 118 and 119 of the associated siding member 110. The engaging portion 125 is held in stable contact with the outer surface of the engaging portion 119. The engaging means 126 of the tile 120 has three steps.

Figure 16:
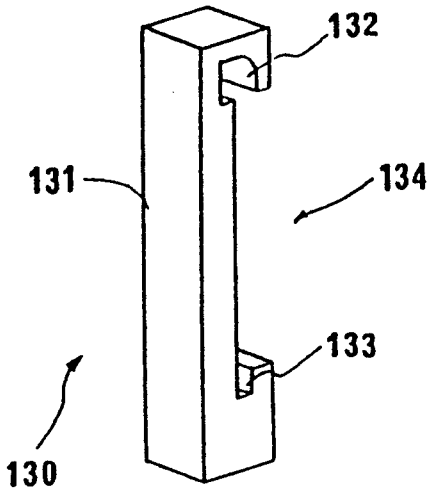

A tile build joint member 130 is provided in each build joint between horizontally adjacent tiles 120. As shown in FIG. 16, the tile build joint member 130 is an independent bar-like member having a height corresponding to the height of the tiles 120 and a width equal to the width of the tile build joint. It has an upper and a lower engaging portion 132 and 133 projecting from the upper and lower edges of its back side and engaging with the respective engaging portions 118 and 119 of the associated siding member 110. The engaging portions 132 and 133 constitute engaging means 134. Unlike the engaging means 126 of the tile 120, with the engaging means 134, although the engaging portion 132 is similar to the engaging portion 122, the engaging portion 133 has an L-shaped sectional profile having an upwardly extending portion for engaging the engaging portion 119 from below. The engaging portions 132 and 133 are engaged with the engaging portions 118 and 119 only with horizontal sliding of the member 130.

The siding members 110, tiles 120 and tile build joint members 130 may be prepared as exterior wall formation units. Each tile 120, having the above sectional profile and engaging means 126, is fitted by hooking its upper and intermediate engaging portions 122 and 124 from above on the respective engaging portions 118 and 119 of the associated siding member 110 and having its intermediate engaging portion 125 in contact with the engaging portion 119. This state of fitting is a temporarily fitted one. The individual tile build joint members 130 are fitted alternately with tiles 120. Since their engaging portions 132 and 133 form opposing grooves, they can be fitted only by sliding engagement of them with the engaging portions 118 and 119. The temporarily fitted tiles 120 are secured in position in tile cross joints by fitting tile cross joint members 140 in the grooves 117 of siding members 110.

Figure 17:
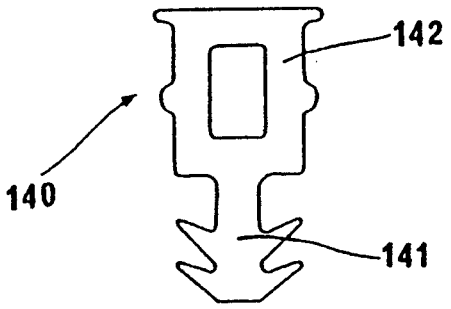

FIG. 17 shows the tile cross joint member 140. This member is a strip-like one made of rubber or like elastic material. It has a leg portion 141 having mounting fins and a hollow main portion 142, these portions being integral with each other. The engaging means 116 on the side of the siding member 110 and engaging means 126 on the side of the tile 120 are initially engaged by mere hooking engagement. With the leg portion 141 of each tile cross joint member 140 forcibly fitted in the associated groove 117, the main portion 142 urges upper and lower tiles 120 and define the gap therebetween as a cross joint. The member 140 thus serves as a stopper against detachment of the tiles 120 in the direction of releasing of the L-shaped engaging means and secures the tiles 120 in position.

Figure 18:
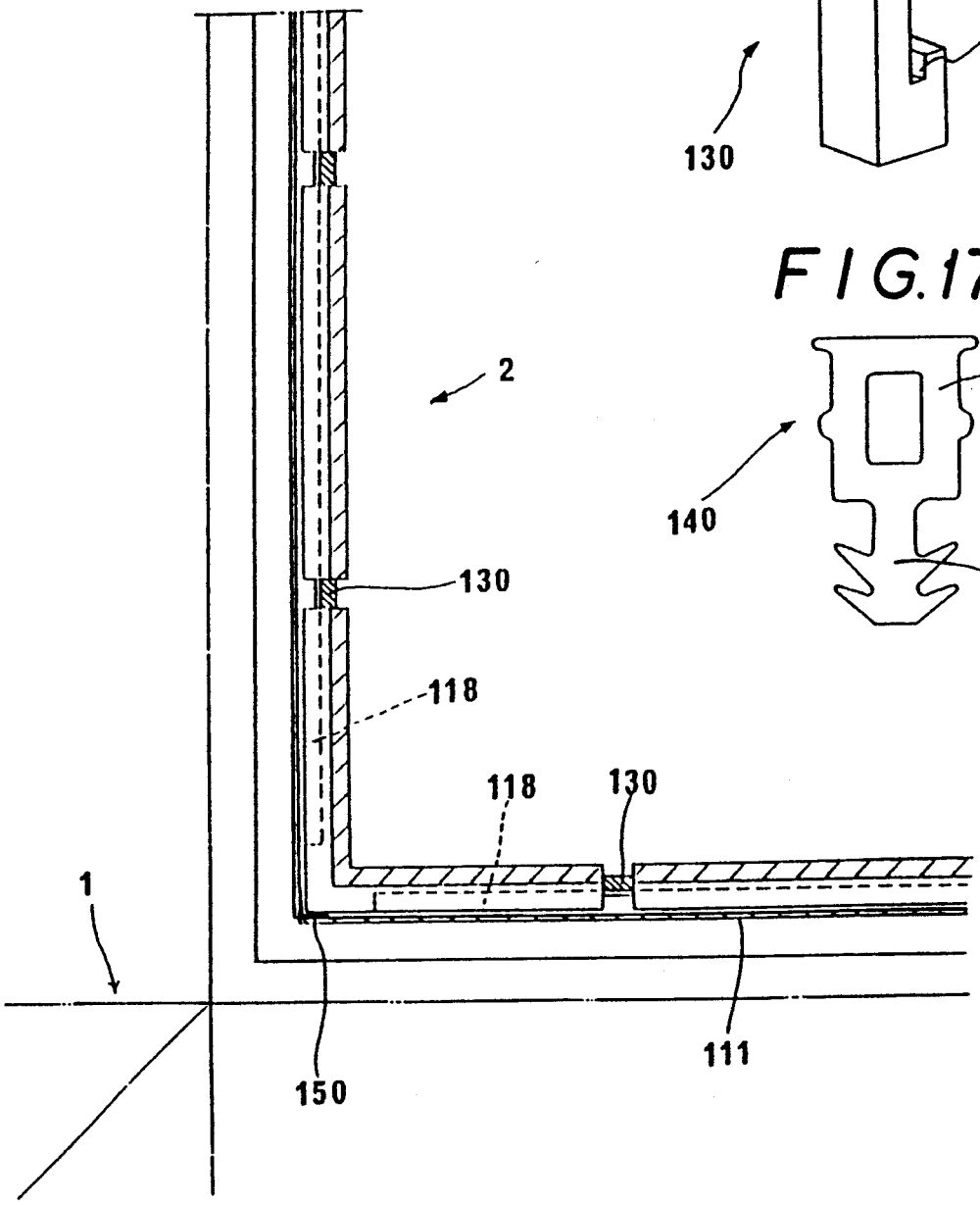
Figure 19:
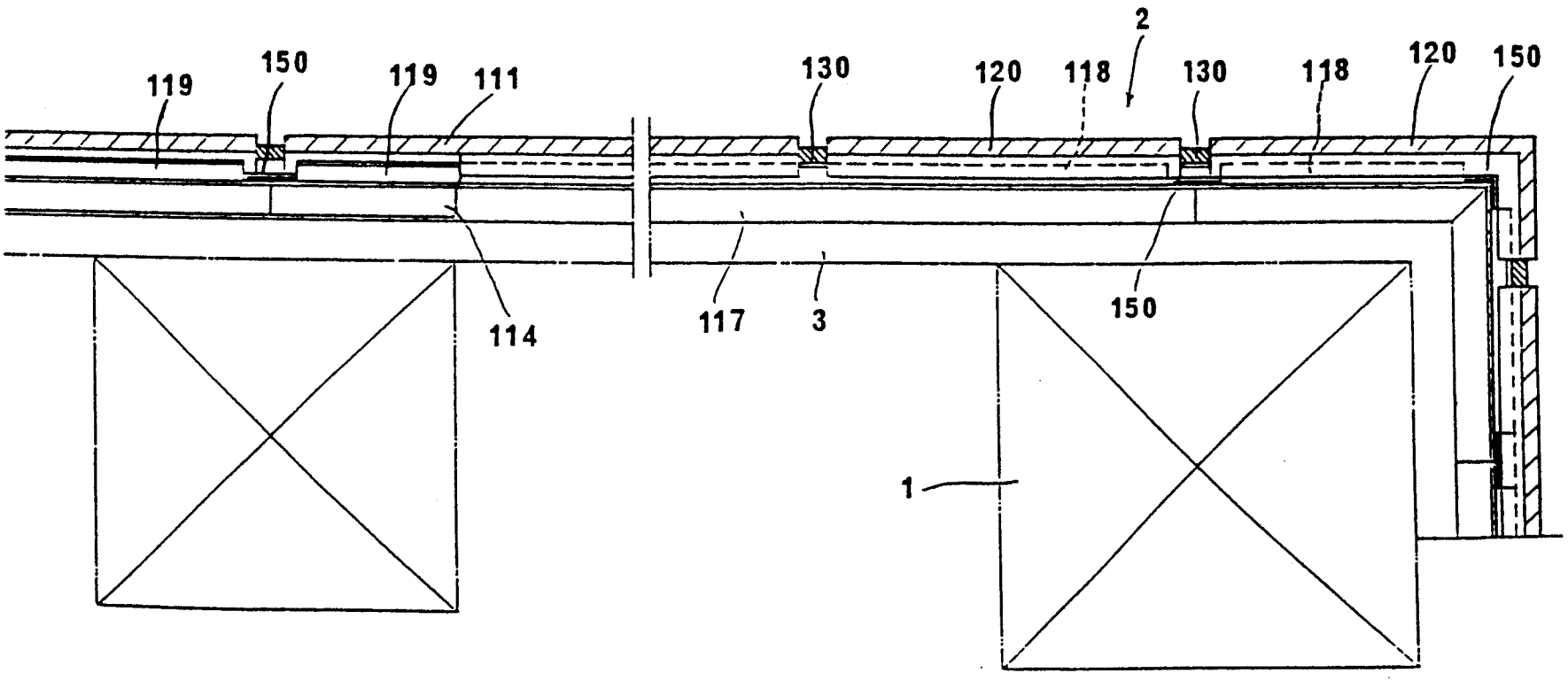
Figure 20:
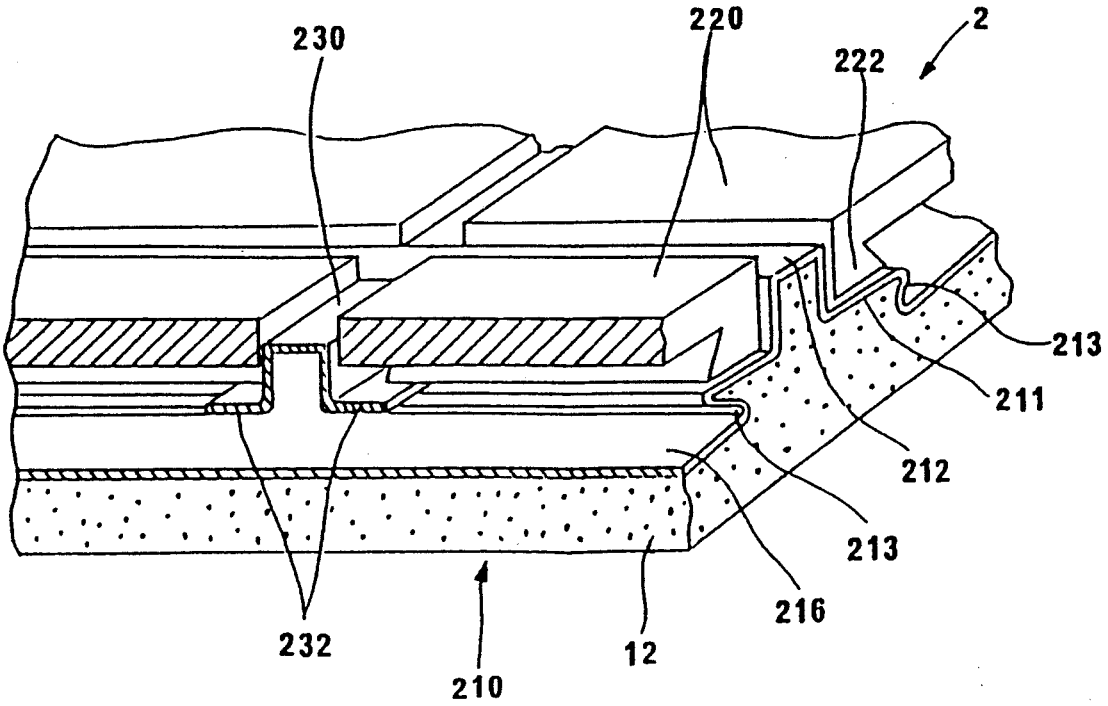

FIGS. 18 and 19 show corner matching parts of siding members 110 at inside and outside corners of the exterior wall 2. In the corner matching parts, the engaging portions 118 and 119 of the engaging means 116 in the corresponding ends of siding members 110 matched at the corner are cut away. Water-proof sheets 150 are applied to flat matching portions, which are formed in this way and free from engaging means.

FIGS. 20 to 24 show an external wall structure according to a third mode of the invention. In this structure, the siding member and tile have modified engaging means. In the Figures, the siding members are designated at 210, and the tiles at 220, while desingating parts like those in FIG. 1 and associated Figures by like reference numerals. In this case, the structure of coupling of these parts is modified.

The siding member 210 is a board-like member similar to the siding member 10 and having an insulating material 12 and a back finish member 13. Its base member 211 has a modified structure having engaging means 216 for engagement with tiles 220.

More specifically, the base member 211 has exterior tile cross joint portions 212 projecting from a vertically intermediate portion and a lower edge portion for engaging with two rows of tiles 220. In addition, it has two recessed portion 213, one formed between an upper shoulder portion extending from an upper lap portion 214 and the upper tile cross joint portion 213, and the other formed between the upper and lower tile cross joint portions 212. The recessed portions 213 have a sectional profile like a dovetail and constitute engaging means 216 for engagement with tiles 220.

Figure 22:
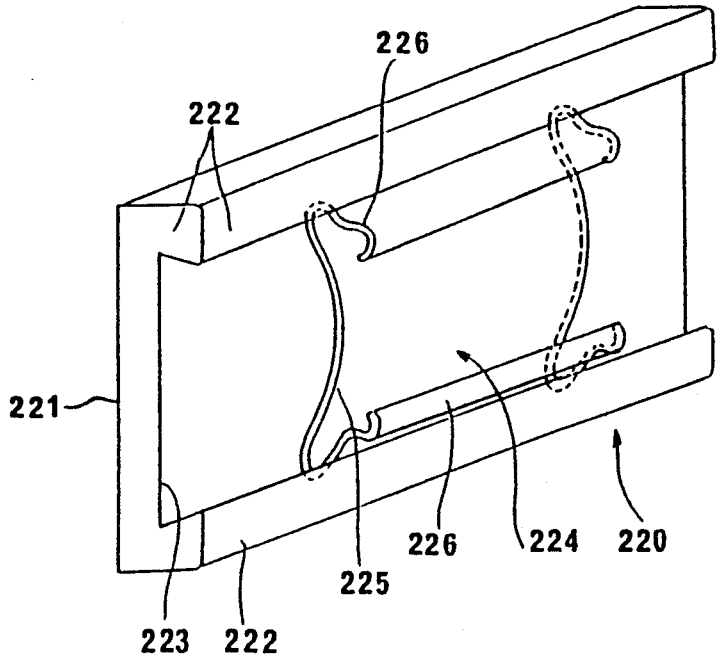

FIG. 22 shows the tile 220. As is shown, the tile 220 has a main portion 221 and engaging ridges 222 extending along the upper and lower edges of its back. In the sectional profile, it has a dovetail recessed portion 223 similar to the recessed portion 213. As the engaging means on the tile side, a sheet-like engaging member 224 made of a metal is fitted between the two engaging ridges 224. The engaging member 224 has a curved main portion 225 fitted with elasticity between the engaging ridges 222 and an upper and a lower foldedly formed engaging leg 226. With its main protion 225 fitted in the recessed portion elasticity in the recessed portion 213 of the siding member 210. Of course, it is possible to first fit the legs 226 of the engaging member 224 in the siding member 210 such that the main portion 225 projects therefrom and then fitting the tile 220 by pushing the same.

Figure 23:
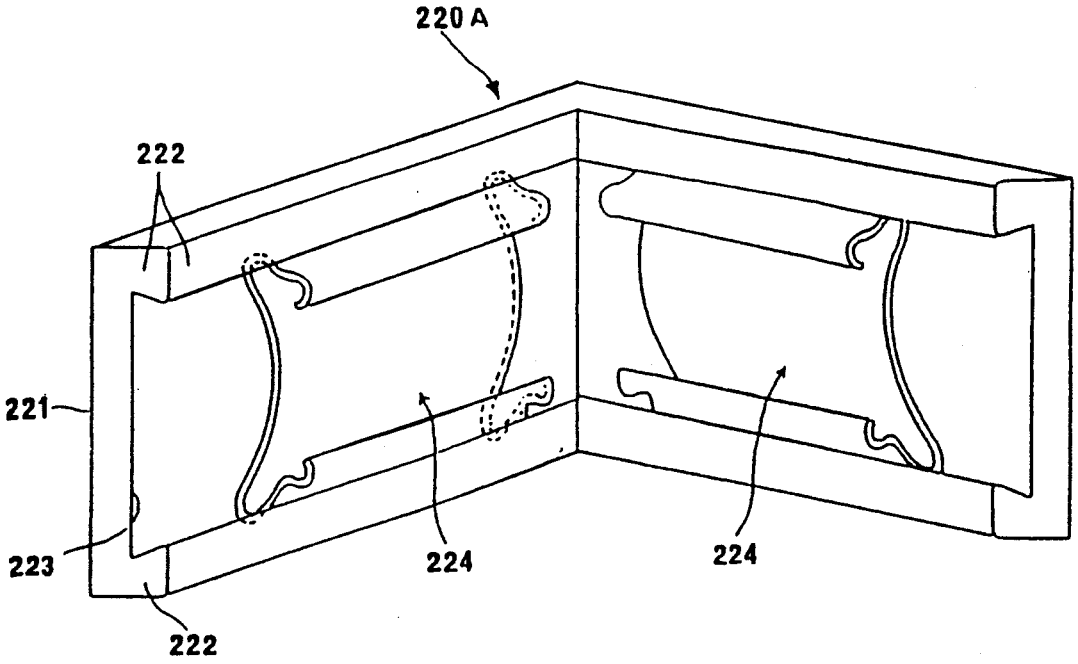

FIG. 23 is a perspective view showing a trim tile 220A produced as a one-piece molding to be used for an outside corner of a building 1. For this tile, two engaging members 224 are used. One of these engaging members 224 is fitted with sliding engaement, while the other one is fitted with elastic fitting. Alternatively, both of them may be fitted by elastic fitting. Similar fitting applies to an outside corner trim tile 220A.

Figure 24:
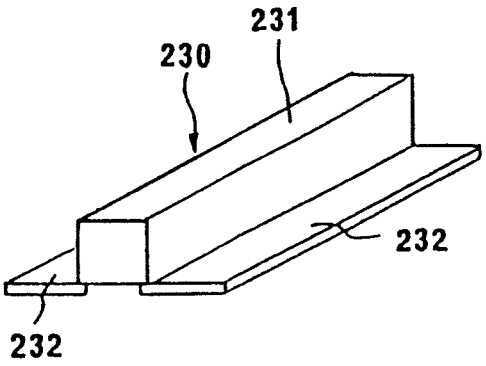
Figure 21:
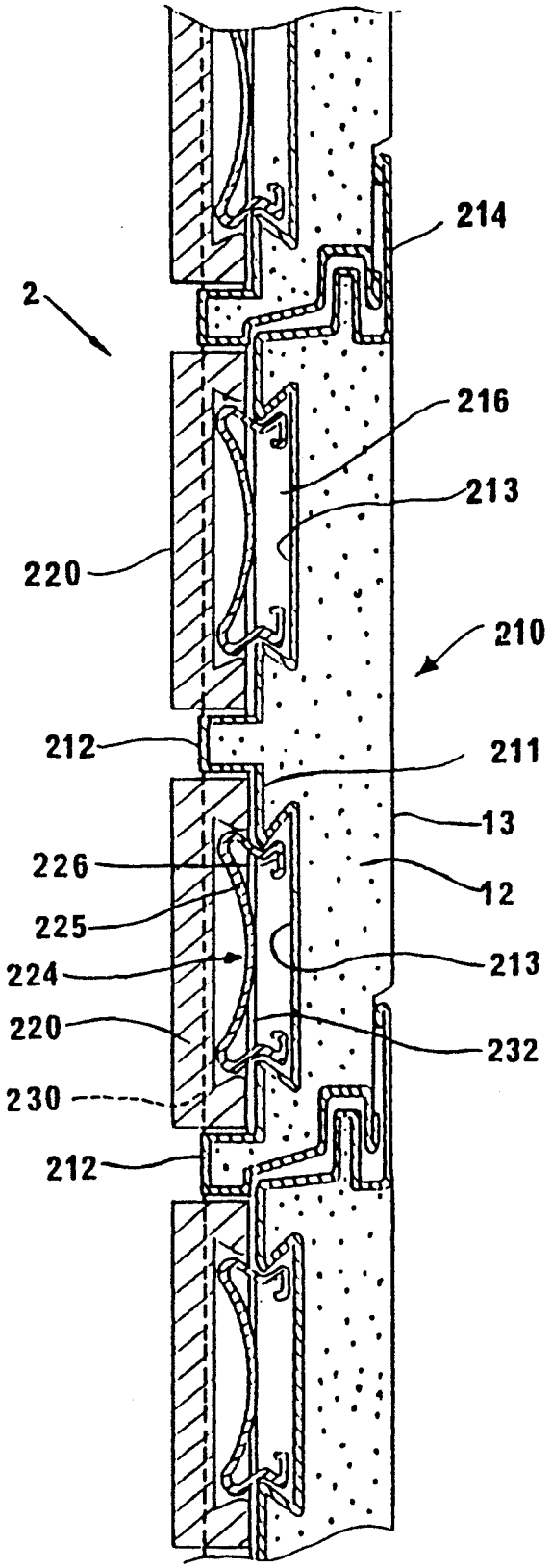
Figure 25:
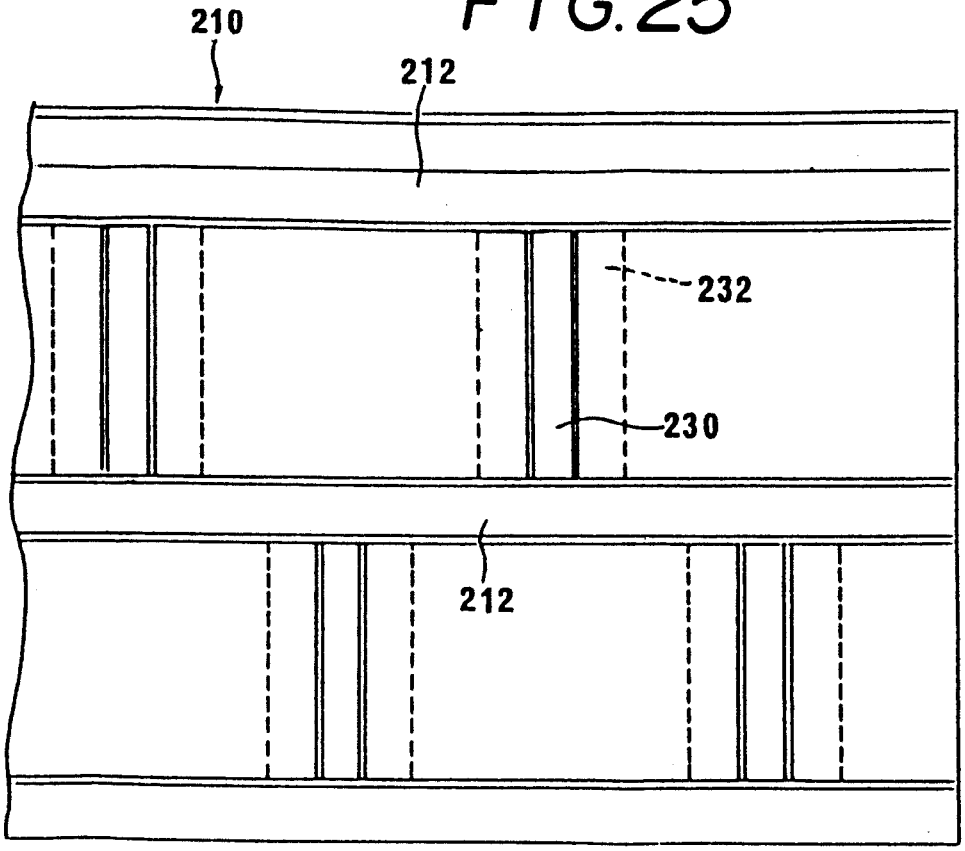
FIG. 25 is a front vertical view showing a further embodiment.

A tile build joint member 230 is provided in a tile build joint between adjacent side-by-side tiles 220. As shown in FIG. 24, the tile build joint member 230 is similar to the tile build joint member 30 noted above and has a main portion 231 and side flanges 232. The flanges 232 are laid againt the back surfaces of tiles 220, and the main portion 231 is flush with the exterior surfaces of the tile cross build joint members 212. Such build joint member 230 is applicable not only to the straight joint as in the example of FIG. 25 but also to the staggered joint.

Figure 26:
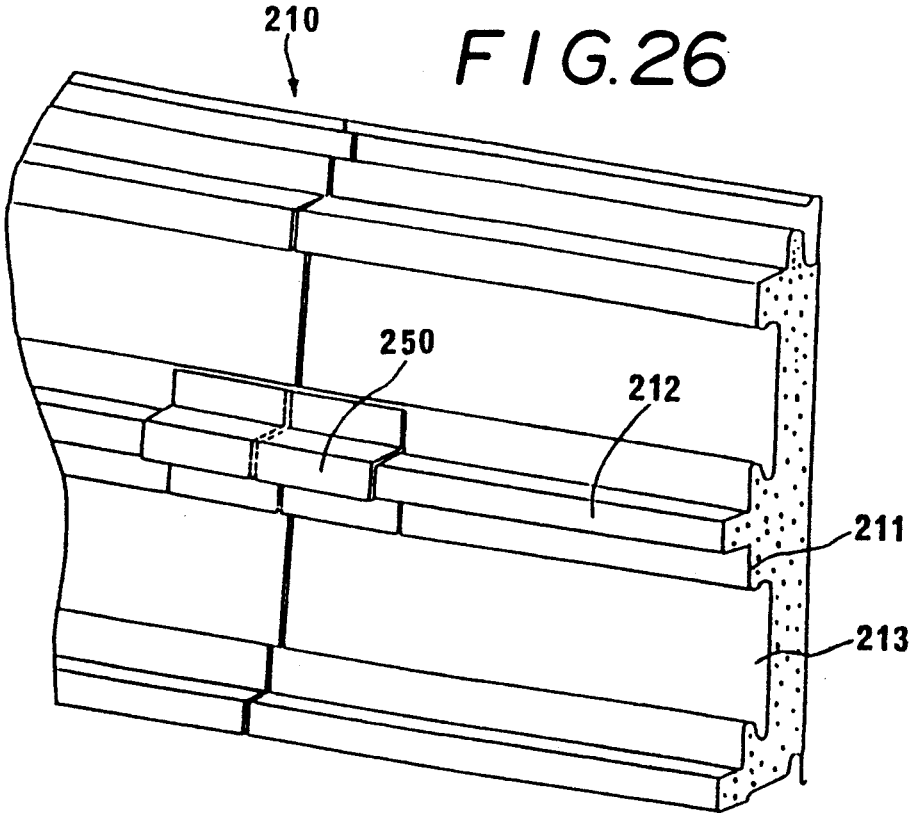
FIG. 26 is a view showing a joint between adjacent siding members.

FIG. 26 shows a joint of opposed ends of adjacent siding member 210. At the end of the tiles cross joint is used a joint member 250 having substantially the same sectional profile. The tile build joint member 230 is fitted such that the recessed portions 213 the opposite side siding members 220 are stridden by its flanges 232. The joint is not exposed to the outside.

FUNCTION

Using the materials as described above according to the invention, the exterior wall 2 is formed basically in the usual way, by fitting siding members 10 one above another on the outside surface of the rough back 3, with each siding member 10 connected to the immediately lower one by engaging the lower edge overlap portion 15 of the upper one with the upper edge overlap portion 14 of the lower one.

Using the materials according to the second mode of the invention, the exterior wall 2 is formed in the usual way, by fitting siding members 110 one above another on the outside surface of the rough back 3, with each siding member 110 connected to the immediately lower one by engaging the lower edge overlap portion 115 of the upper one with the upper edge overlap portion 114 of the lower one. In this case, between vertically adjacent siding members 110 tile cross joint members 140 are fitted in tile cross joints between vertically adjacent tiles 120 by forcibly fitting the leg portions 141 of the members 140 into the recesses 117. Thus, the tiles 120 which have been hooked on and temporarily secured to the siding members 110 are restricted against movement in the direction of the detachment and are thus secured to the siding members 110.

Using the materials according to the third mode of the invention, the exterior wall 2 is formed in the usual way, by fitting siding members 210 one above another on the outside surface of the rough back 2, with each siding member 210 connected to the immediately lower one by engaging the lower edge overlap pjortion 215 with the upper edge overlap portion 214 of the lower one.

In either case, the exterior wall 2 is formed by using its units prepared with siding members and tiles as exterior material. The accuracy of tile setting can be ensured.

INDUSTRIAL UTILITY

As has been shown, according to the invention, there is provided an exterior wall unit structure for forming an exterior wall of a building structure, which comprises a siding member made of a metal and one or more porcelain tiles corresponding in size to and fitted to the outside surface of the siding member, the siding member having the outside surface formed with engaging means extending in the horizontal direction for engagement with the tiles or tiles each tile being formed with engaging means for engagement with the engaging means of the siding member, each tile being coupled to the outside surface of the siding member to be integral therewith with the engagement of both the engaging means. The siding member is formed by bending a metal sheet such that opposed paired sides thereof are formed with connecting means permitting fitting connection between adjacent siding members. According to the basic mode of the invention, the engaging means of the siding member is constituted by a downwardly directed and an upwardly directed L-shaped portion formed along the upper and lower edges, respectively, and the engaging means of each tile is constituted by upper and lower edge portions capable of being fitted in the spaces defined by the L-shaped portions, each tile being fitted in the siding member with sidewise sliding therealong, the engaging means of the siding member forming a tile cross joint when vertically adjacent siding members are coupled together. According to the second and third modes of the invention, the siding members have modified engaging means. Thus, the siding members and tiles may be combined in factories into exterior wall units corresponding in size to predetermined siding member sizes, thus permitting increase of the site work efficiency and accuracy of construction. Thus the various drawbacks inherent in the prior art can all be precluded. That is, the exterior wall units require no skill of any expert for fitting, can contribute to the reduction of the construction period as dry construction, and permits regular tiling of wooden building structures as well to provide stability senses and imposing characters.

What is claimed is:

1. An exterior wall unit comprising:

a siding member having at least one engaging means disposed thereon;

at least one tile unit bearing at least one engaging means disposed on the back side thereof, the engaging means on the siding member engaging the engaging means on the tile unit when the tile unit is installed on the siding member;

at least one tile cross joint member; and at least one cavity formed on said siding member for receiving a first portion of said tile cross joint member, a second portion of said tile cross joint member bearing against a side of said tile unit locking said at least one tile unit on said siding member.

2. The exterior wall unit according to claim 1, further comprising at least one tile build joint member disposed between adjacent tiles.

3. The exterior wall unit according to claim 2, wherein a tile build joint member is in each tile build joint, said tile build joint member being engaged by sole sliding with an engaging portion formed on the outside surface of said siding member.

4. The exterior wall unit of claim 1 wherein said siding member further comprising:

a first end and a second end wherein said first end and said second end of said siding member having connecting means to couple with yet another siding member.

5. The exterior wall unit of claim 1 wherein:

said at least one engaging means of said siding member has a plurality of engaging means extending in a first direction from a surface of said siding member; and said engaging means on said at least one tile unit extends in a second direction opposite to said first direction to provide an engagement between said at least one tile unit and said siding member.

6. The exterior wall unit in claim 1 wherein said at least one tile cross joint member is of an elasticized material.

7. The exterior wall unit in claim 6 wherein said first portion of said at least one tile cross joint member has a plurality of leg portions to firmly engage with walls of said cavity.

8. The exterior wall unit in claim 7 wherein said cavity has an opening for receiving said first portion of said at least one tile cross joint member, said opening being smaller in one direction than is the interior of said cavity.

* * * * *